United States Patent [19]

Placek

[11] 3,941,116

[45] Mar. 2, 1976

[54] INFRARED HEAT GENERATOR

[75] Inventor: Eugene W. Placek, Middleburg Heights, Ohio

[73] Assignee: International Magna Corporation, Cleveland, Ohio

[22] Filed: Aug. 2, 1974

[21] Appl. No.: 494,324

[52] U.S. Cl. ..... 126/92 B; 431/329; 431/353

[51] Int. Cl.[2] ..... F24C 3/04

[58] Field of Search ..... 126/92 R, 92 B, 127.1, 126/127.2; 431/7, 147, 258, 259, 353, 354, 329, 327

[56] References Cited

UNITED STATES PATENTS

| | | | |
|---|---|---|---|
| 2,808,714 | 10/1957 | Wilson | 431/147 |
| 3,139,879 | 7/1964 | Bauer et al. | 126/92 B |
| 3,139,881 | 7/1964 | Fannon, Jr. | 431/353 |
| 3,229,680 | 1/1966 | Hebert et al. | 431/329 |
| 3,857,670 | 12/1974 | Placek et al. | 431/329 |

*Primary Examiner*—Kenneth W. Sprague
*Assistant Examiner*—James C. Yeung
*Attorney, Agent, or Firm*—Allen Owen

[57] ABSTRACT

A gas fired infrared heat generator having certain special features is disclosed. The device includes a dead man control valve within the fuel line operable from the handle and so arranged that, in conjunction with spacer means across the front of the reflector, the gas valve will close if the tool is dropped or left unattended on a surface. Multiple couplings are provided on the combustion chamber of the device for connecting the handle and gas line assembly to either the back of the combustion chamber for use of the heater in an upward direction or to one side of the combustion chamber for use on other surfaces.

2 Claims, 4 Drawing Figures

INFRARED HEAT GENERATOR

BACKGROUND OF THE INVENTION

The invention relates to radiant heaters, and more particularly to an improved gas-fired infrared heat generator.

The type of tool to which this invention relates is disclosed in U.S. Pat. Nos. 3,040,805, 3,129,749, 3,198,240 and 3,814,573. Such a device generally burns a fuel such as propane from a pressurized source mixed with air in a combustion chamber which is defined by an inner mantle or gas diffuser and an outer grid across the face of the tool. The gas diffuser usually comprises a series of overload wire grids of various opening sizes which disperse the effluent gas streams so finely that the burning actually takes place on and adjacent to the surface of the wire grids. A red-hot glow is produced across the grids, and intense infrared radiation is emitted therefrom. Generally a reflector enshrouds the face of the gas diffuser to directionally intensify the radiant heat given off by the tool. The infrared heating tools are used for a variety of purposes including paint and wall paper removal and numerous heating, thawing and drying purposes.

Infrared heat generators generally include a manually operable rotatable screw-type valve for initiating and regulating the flow of gas into the combustion chamber. While this arrangement is very convenient, it can be extremely hazardous under certain circumstances. For example, if the operator either carelessly leaves the tool burning or suffers a disabling attack of some kind while he is operating the tool, the danger of starting a fire is very high. This is particularly true with a heavy duty type burner which is capable of applying a great deal of intense heat to closely positioned objects and structures.

Another difficulty and often potential hazard encountered with present infrared heat generators is that they generally have no provision establishing a minimum distance between the diffuser and the work surface, except for the limitation proposed by the reflector itself. Because such provision is lacking, severe scorches and fires on the work can easily be caused by an overzealous operator holding the tool too close to the work during, for example, paint stripping or wall paper removal. The sub-visual radiant nature of the heat produced often causes an operator to lose sight of the high intensity of the heat.

A less serious difficulty often encountered with many present radiant burners is the invasion of their fuel lines and fuel-air mixing chambers by insects. The air intake openings of the tool provide access for the insects, which typically nest inside the gas line and mixing chamber, clogging gas openings and reducing or nullifying the output of the tool. Spiders in particular cause a great deal of such trouble.

SUMMARY OF THE INVENTION

The improved infrared heat generator of the present invention eliminates most of the difficulties and hazards encountered with previous burners. Instead of a rotatable screw type fuel valve, the present burner employs a spring-loaded, on-off, normally closed "dead man" gas valve adjacent its handle so that an operator must apply pressure to the valve to sustain fuel flow to the combustion chamber.

The present infrared generator also includes spacer bars across and extending outward from its reflector to maintain a minimum distance between the diffuser and the work surface. As indicated above, the provision of this spacing means is a significant safety feature. However, not only does the spacing means prevent too close proximity of the hot mantle with the work, but it also cooperates with the spring-loaded valve lever on the handle to prevent depression of the lever and opening of the valve when the tool lies at rest on a surface. The protruding spacers and the lower end of the handle define the points of contact of the tool lying face down on a flat surface. Thus the gas valve handle cannot be engaged by such a surface and opened by the weight of the tool to admit fuel to the combustion chamber and therefore create a hazardous situation.

The infrared heater of this invention includes an insect screen peripherally disposed around the air intake holes, thereby preventing fuel flow difficulties due to the nesting of spiders and other insects.

Another improvement included in the present infrared generator is the provision of multiple couplings for connection of the gas line and handle assembly to the mixing chamber, mantle and reflector assembly so that the handle can be arranged either parallel or perpendicular to the planes of the mantle and reflector and the tool can therefore be used to radiate heat either in a lateral or downward direction or in an upward direction.

DESCRIPTION OF THE PREFERRED EMBODIMENT

Figure 1:
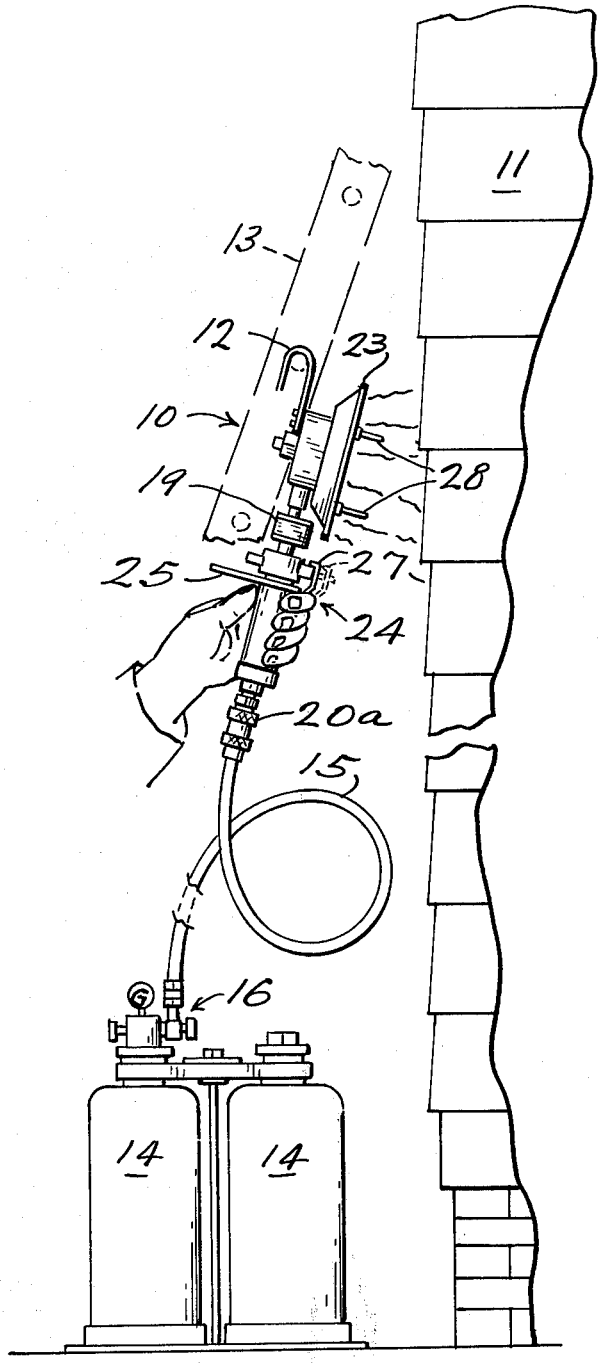
FIG. 1 is an elevational view showing an infrared heat generator of the present invention being employed to remove paint from the exterior surface of a structure.

In the drawings, FIG. 1 shows an infrared heater 10 according to the invention in position for removing paint from the exterior of a house or other structure 11. The heater 10 includes a support bracket 12 for hanging the tool on a suuport such as a ladder 13 (shown in phantom) during interim periods when the tool is not being operated. Fuel tanks 14 containing a pressurized fuel gas such as propane deliver the fuel through a flexible line 15 to the tool 10. A preset regulator valve 16 is provided to supply the correct volume of gas flow to the heater. The operator of the tool 10 controls the flow of gas by means of a simple on-off valve as described below.

Figure 2:
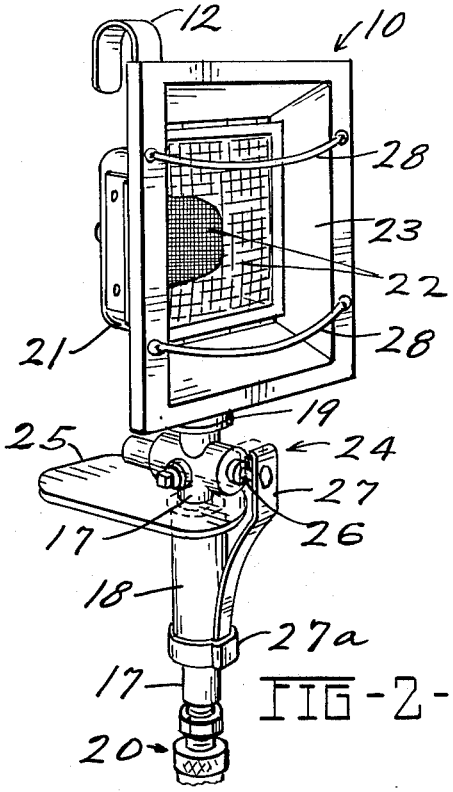
FIG. 2 is a perspective view of the heat generator.

As best indicated in FIG. 2, the heat generator 10 includes a fuel line 17 passing through a handle 18, an air intake screen 19, a plenum or mixing chamber 21, wire combustion grids 22 and a peripheral reflector 23. Forming the lower extremity of the fuel line 17 is a quick-disconnect coupling 20 including a swivel joint 20*a*. The coupling 20 automatically shuts off gas flow through the line 15 upon its disconnection. On the handle 18 is a dead man valve assembly 24 including a valve plunger rod 26 of linear throw transverse to the handle 18 and a valve lever 27 positioned for engagement by the hand of the operator holding the handle 18. The lever 27 is slotted at its lower end, received by a slide retainer 27*a* which maintains alignment of the lever 27 and provides for its smooth operation. The valve assembly 24 is spring-loaded so that its normal position is closed, with the lever 27 and plunger rod 26 at their maximum outward positions. The purpose of the dead man control 24 is to cut off the flow of fuel to the mixing chamber 21 and combustion grids 22 when the tool is left unattended, thereby substantially reducing the risk of fire.

Also on the handle 18 is a guard plate 25 for helping protect the operator's hand from accidental burns. The plate 25 may additionally be used as a stabilizer for supporting the weight of the tool on the operator's hand.

Across the face of the reflector 23, as seen in FIGS. 1 through 4, are a pair of bowed metal spacer bars 28 which maintain a minimum distance between the hot combustion grids 22 and the surface of the work being heated. As FIG. 3 indicates, the lower of the bars 28 cooperates with the lower extremity of the handle 18 or the fuel line 17 to prevent the valve lever 27 from being depressed by the weight of the tool should the tool be positioned face down on a flat surface 29. When the tool 10 is connected to the flexible line 16, the valve lever 27 in its off position remains well above the surface 29 as the tool rests with its lowermost rigid extremity against the surface 29.

Figure 3:
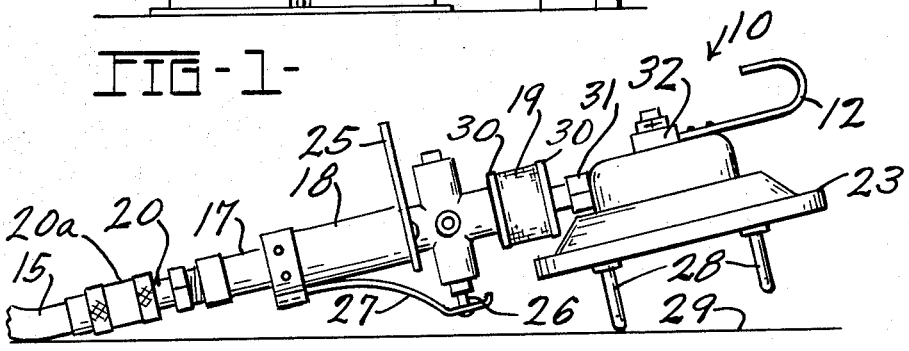
FIG. 3 is a side view of the heat generator lying face downward on a surface.

As shown in FIG. 3, the air intake screen 19 comprises a cylindrically positioned wire mesh retained by upper and lower flanged plates 20 about the fuel line 17, which includes air openings (not shown) therein.

Figure 4:
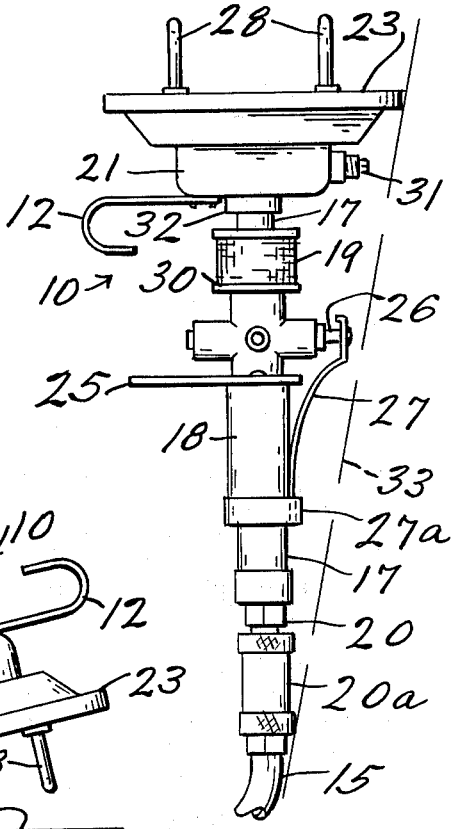
FIG. 4 is an elevational view of the heat generator adapted to direct heat upwardly.

Also indicated in FIG. 3 are a pair of couplings 31 and 32 for connection of the upper end of the fuel line 17 to the plenum or mixing chamber 21. In FIGS. 1, 2 and 3, the side coupling 31 is employed, putting the handle parallel to the plane of the reflector 23, the rear coupling 32 being plugged. FIG. 4, on the other hand, shows the line 17 connected to the rear coupling 32 on the mixing chamber 21, placing the handle 18 perpendicular to the face of the reflector 23 and adapting the tool for upward use such as for stripping paint off ceilings. In this instance, the coupling 31 is plugged. As the dashed line 33 indicates, the tool 10 arranged as in FIG. 4 cannot accidentally emit gases or remain burning when lying against a surface with its valve lever 27 downward.

Various other embodiments and alterations to this preferred embodiment will be apparent to those skilled in the art and may be made without departing from the spirit and scope of the following claims.

I claim:

1. In a gas-fired infrared heat generator including a fuel line for connection to a fuel tank, an air intake within the line, a mixing chamber connected to the downstream end of the fuel line, a mantle defining a forward boundary of the mixing chamber, an outer grid disposed outwardly from the mantle, a reflector disposed peripherally about the mantle and grid, a handle extending along the fuel line generally parallel to the faces of the mantle and the reflector, and a lower extremity adjacent the bottom of the handle, the improvement comprising:

at least one spacer member mounted on the reflector and extending outwardly forward therefrom for maintaining the outer grid a predetermined distance from an adjacent surface; and a spring-biased, normally closed gas valve operably connected into the fuel line for preventing the flow of fuel into the mixing chamber when the heat generator is unattended, said valve being of linear travel normal to the face of the reflector and including a plunger rod extending from a position below the reflector and a manually operable, squeezeresponsive lever operably connected to the plunger rod adjacent the handle, said lever having an outer valve closed position which lies inside a space whose outer boundary is defined by a line between the spacer member and the lower extremity of the generator adjacent the bottom of the handle, whereby said normally closed valve closes and remains closed when the heat generator rests face down and unattended against a surface.

2. The heat generator of claim 1 wherein the mixing chamber is detachably connected to the fuel line and has on its rearward side an alternate connection for the fuel line, whereby the faces of the mantle, grid and reflector may be oriented perpendicularly to the fuel line and handle, and wherein the outer valve closed position of the handle, when the mantle, grid and reflector faces are so oriented, lies inside a space whose outer boundary is defined by a line between an edge of the reflector and the lower extremity of the generator adjacent the bottom of the handle.

* * * * *